US005189304A

United States Patent [19]

De Chambost et al.

[11] Patent Number: 5,189,304

[45] Date of Patent: Feb. 23, 1993

[54] HIGH TRANSMISSION MASS SPECTROMETER WITH IMPROVED OPTICAL COUPLING

[75] Inventors: Emmanuel De Chambost, Limours; Bernard Rasser, Paris, both of France

[73] Assignee: Cameca, Courbevoie, France

[21] Appl. No.: 747,027

[22] Filed: Aug. 19, 1991

[30] Foreign Application Priority Data

Aug. 24, 1990 [FR] France ..... 90 10632

[51] Int. Cl.[5] ..... H01J 49/32

[52] U.S. Cl. ..... 250/296; 250/281; 250/396 R

[58] Field of Search ..... 250/296, 281, 282, 288, 250/298, 299, 396 R

[56] References Cited

U.S. PATENT DOCUMENTS

| | | | |
|---|---|---|---|
| 4,078,176 | 3/1978 | Matsuda | 250/296 |
| 4,329,618 | 5/1982 | Chang | 313/431 |
| 4,418,280 | 11/1983 | Matsuda | 250/296 |
| 4,553,029 | 11/1985 | Matsuda | 250/296 |
| 4,638,160 | 1/1987 | Slodzian et al. | 250/296 |
| 4,672,204 | 6/1987 | Slodzian et al. | 250/298 |
| 4,694,169 | 9/1987 | Uchida | 250/296 |
| 4,766,314 | 8/1988 | Jung | 250/296 |

FOREIGN PATENT DOCUMENTS

| | | | |
|---|---|---|---|
| 0013003 | 7/1980 | European Pat. Off. . | |
| 0225717 | 6/1987 | European Pat. Off. . | |
| 2324119 | 4/1977 | France . | |
| 0064090 | 6/1978 | Japan | 250/296 |

OTHER PUBLICATIONS

Japanese Abstract, vol. 9, No. 298, (E-361) (2021) Nov. 26, 1985 JP-A-60-13883, Fumo Kunihiro, Jul. 23, 1985, "Mass Spectrograph".

*Primary Examiner*—Jack I. Berman
*Assistant Examiner*—James Beyer
*Attorney, Agent, or Firm*—Oblon, Spivak, McClelland, Maier & Neustadt

[57] ABSTRACT

The disclosed mass spectrometer has, positioned between an input slit and an output slit, crossed by particles emitted by a sample, an optical coupling system placed between two respectively electrostatic and magnetic sectors. The optical coupling system comprises at least two lenses with slits oriented respectively along a first direction in which the path of the ions is incurvated by the electrostatic and magnetic sectors and along a direction perpendicular to the plane of the path. The position of the two lenses on the optical axis of the spectrometer is determined to obtain a compensation for the chromatic dispersions throughout the axis downline from the spectrometer, a stigmatic image of the input slit in the output plane of the spectrometer and a stigmatic image downline from the spectrometer.

13 Claims, 5 Drawing Sheets

HIGH TRANSMISSION MASS SPECTROMETER WITH IMPROVED OPTICAL COUPLING

BACKGROUND OF THE INVENTION

1. Field of the Invention

The present invention relates to a high transmission stigmatic mass spectrometer as used in secondary ion mass spectrometry (SIMS). SIMS is described by A. Benninghoven et al in "Secondary Ion Mass Spectrometry" in *Chemical Analysis,* vol. 86, John Wiley and Sons, section 4, pp. 329 to 664.

In a SIMS instrument, that part of the instrument which is located downline from the sample and from the secondary ion extracting devices forms a mass spectrometer, the spectrometry of which greatly differs from that of thermo-ionization spectrometers in that the secondary ions emitted generally display a far more appreciable energy dispersion which may typically be as great as 20 eV. Under these conditions it is advantageous, in these instruments, not to filter the energy particle beams so as to preserve the entire ion signal available, one of the expected performance characteristics of the spectrometer being that it should have efficient transmission for a determined mass resolution, the term "transmission" designating the part of the secondary beam that is accepted by the spectrometer and the term "mass resolution" designating the smallest difference in mass between two masses that are measured separately. However since, in any spectrometer, it is necessary to diaphragm the particle beam to obtain a fixed mass resolution, it may be intuitively thought that the greater the mass resolution required, the more limited will be the transmission of the beam and the weaker will be the signal available to carry out the measurement.

The mass dispersion is obtained by making the particle beam go through a magnetic field created by the magnet of a magnetic sector "MS". Each non-relativistic particle that goes through the magnet is then deflected along a circular path with a radius of curvature $R_m$ defined by a relationship having the form:

$$R_m = mv/qB = (1/B)\cdot(2mV/q)^{\frac{1}{2}} \quad (1)$$

according to which B designates the magnetic field, m the mass of the particle, V the acceleration voltage of the particle, q its electrical charge and v its speed. However, the relationship (1) reveals a phenomenon of chromatic dispersion of the magnetic sector which may seriously restrict the mass resolution by the fact that the radius of curvature $R_m$ depends both on the acceleration voltage V and on the mass m and that the energy dispersions in the SIMS analyses are relatively great.

As is also explained in the work by A. Benninghoven, this problem is usually resolved by compensating for the chromatic dispersion of the magnetic sector by that of an electrical field created by a voltage applied between two electrodes between which the particle passes. Under these conditions, the particle is further deflected along another circular path, the radius of curvature $R_e$ of which verifies a relationship of the form:

$$R_e = 2V/Q/qE \quad (2)$$

in which V represents the acceleration voltage of the particle, E the electrical field prevailing between the two electrodes and q the electrical charge of the particle. The relationship (2) shows that the radius $R_e$ depends on the acceleration voltage but not on the mass. This makes it possible to state that an electrical field disperses chromatically but does not disperse in terms of mass. Consequently, to make a device, at the output of which the paths have a deflection depending on the mass but not on the energy of the particle, it is usual to associate an electrostatic sector ES that creates an electrical field on the journey of the particle to a magnetic sector MS which creates a magnetic field. Naturally, in this association, the characteristics of the electrical and magnetic sectors and their arrangement should be such that the chromatic dispersions compensate for each other exactly so that the spectrometer thus obtained is achromatic. Again, according to the prior art, two types of spectrometer may usually be considered, depending on whether the achromatism takes place at a single point of the output axis of the spectrometer or takes place throughout the output axis of the spectrometer. In these spectrometers, the achromatic output plane of an electric or magnetic sector is the plane on which there is located the point from which the energy dispersed paths seem to have emerged. The achromatic input plane is symmetrical with that of the output if the sector is symmetrical. Also in these spectrometers, any particles having a difference in energy _E and converging towards the achromatic plane always take a path that leaves on the axis, and the achromatism on the axis implies that the the achromatic output plane of the electrostatic sector ES and the achromatic input plane of the magnetic sector MS are conjugate.

A known arrangement to achieve the achromatism throughout the axis of a spectrometer is, for example, that of the instrument IMS3F, marketed and manufactured by the Applicant Firm CAMECA. A description corresponding to this instrument may be found in an article by M. Lepareur, *Le micro-analyseur de second generation CAMECA module 3F* (The Module 3F CAMECA Second-Generation Micro-Analyzer) in the *Revue THOMSON CSF,* vol. 12, No. 1, Mar. 1980.

The usefulness of this arrangement is that, in addition to achieving achromatism throughout the axis, it projects, on the image intensifier, the ionic image of the mass filtered sample.

However since, in addition to their deflecting properties, the electrostatic or magnetic sectors possess focusing properties that depend on the shape given to the electrodes of the ES and to the pole pieces of the MS, these sectors generally have no symmetry of revolution, and the convergence along the two directions Oy and Oz, normal to the optical axis, is not identical. However, in the IMS3 apparatus, the spherical electrodes of the electrostatic sector ES have a focal length fe that is equal in the directions Oy and Oz and the planes located on each side of the electrostatic sector ES, at a distance, from the input faces, that is equal to the radius of the electrostatic sector ES, are conjugate. Furthermore, the shape given to the input faces of the magnetic sector MS gives it an optical diagram equivalent to that formed by a doublet of lenses. As a result, the lenses have equal focal lengths fm for the two directions Oy and Oz, and the space between them is not identical in the two directions. An input slit is placed at a distance fe upline from the input face of the electrostatic sector ES; an output slit is positioned at a distance fm downline from the magnetic sector MS. These two slits are optically conjugate and play a roughly equivalent role. It is the setting of the input slot that determines the mass resolution. To make a selection, according to a chromatic criterion, of the particles to be taken into account by the analysis, an energy slit is positioned at a distance fe from the output face of the electrostatic sector ES. In normal operation, the illumination pupil of the secondary emission, also called the cross-over, is imaged on the input slit and, hence, on the output slit. The plane of the sample is located on a diaphragm located just at the input of the electrostatic sector ES. Because of the disparity, in the directions Oy and Oz, of the spaces between the doublet lenses of the equivalent diagram of the magnetic sector MS, a stigmator is needed in a plane close to the output slit to enable the projection of the stigmatic image of the plane of the sample.

In this apparatus, an optical coupling device is placed between the electrostatic sector ES and the magnetic sector MS, firstly, so as to compensate for the chromatic dispersion of the electrostatic sector by that of the magnetic sector and, secondly, so as to conjugate the planes of the input slit and output slit. As is also described in the above-mentioned article by M. Lepareur, the optical coupling device may be made by means of a single lens. Once the optical characteristics of the two sectors, namely the magnetic and electrostatic sectors MS and ES, have been defined, there is only one configuration, having the parameters of distance between the two sectors, position of the lens, and excitation of the lens, that enables both compensating for the chromatic dispersions and conjugating the output slit with the input slit.

In this configuration, the achromatic output plane of the ES and the achromatic plane of the MS are conjugate.

However, as in every spectrometer, the mass resolution ΔM/M with respect to the width of the input slit and the characteristics of the sectors is determined by a relationship having the form:

$$\frac{\Delta M}{M} = \frac{W_{ys}}{K_M} + \frac{K_y}{K_M}\theta_{ys}^2 + \frac{K_z}{K_M}\theta_{zs}^2 \quad (3)$$

where

ΔM/M is the resolution in mass.

ΔWys is the width of the Gaussian image of the input slit at the output plane of the spectrometer;

$K_M$ is the coefficient of dispersion in mass of the magnet defined by $dy = K_M\, dM/M$;

Ky and Kz are the coefficients of the second order aberration of the spectrometer;

θys and θzs are the angular apertures of the beam at the output plane.

The relationship (3) expresses the fact that the angular apertures along the orthogonal directions OY and OZ in the plane of the slits produce second order aberrations in the direction OY which is the direction of the mass dispersion.

Since the quantity of ions taken into account by the analysis is proportional to the product Wys x θys, there should certainly exist an optimum of the pair (Wys, θys) that minimizes the differences between two masses that can be resolved resolution in mass. However, there is every reason to reduce the aperture θzs by optical means, it being understood that, as a result, the image Wzs is enlarged, but that this image has no effect on the resolution in mass.

An attempt to reduce the aperture of the beam at Z has been made on an Australian instrument known as SHRIMP where a four-pole lens, positioned before the electrostatic sector ES, squeezes the beam at Z. A description of this apparatus is given in an article by S. Clement, W. Compston, G. Newstead, "Design of a Large, High Resolution Ion Microprobe" in A. Benninghoven ed. *Proceedings of the International Conference on SIMS and Ion Microprobes,* Springer Verlag, 1977. But, in this instrument, it is not possible to project the image of the analyzed sample after the spectrometer.

SUMMARY OF THE INVENTION

An aim of the invention is to overcome the abovementioned drawbacks.

To this effect, an object of the invention is a high transmission stigmatic mass spectrometer with double focusing, of the type comprising, between an input slit and an output slit crossed by particles emitted by a sample, an optical coupling system placed between two respectively electrostatic and magnetic sectors, wherein said optical coupling system comprises at least two lenses with slits oriented respectively along a first direction in which the path of the ions is incurvated by the electrostatic and magnetic sectors and along a direction perpendicular to the plane of the path, the position of the two lenses on the optical axis of the spectrometer being determined to obtain a compensation for the chromatic dispersions throughout the axis downline from the spectrometer, a stigmatic image of the input slit in the output plane of the spectrometer and a stigmatic image downline from the spectrometer, of a plane not conjugate with the input slit, in a plane distinct from the output plane.

BRIEF DESCRIPTION OF THE DRAWINGS

Other features and advantages of the invention shall appear from the following description, made with reference to the appended drawings, of which.

DESCRIPTION OF THE PREFERRED EMBODIMENTS

The invention makes profitable use of the fact that the aberrations of aperture in the direction of the axis OZ are far greater in a magnetic sector MS than in an electrostatic sector ES. It enables the setting up of an optical coupling between the two sectors making it possible to preserve the advantages obtained by an apparatus and as the IMS3F. The spectrometer shown in FIG. 1 includes, positioned on each side of of an optical coupling system $L_y$ (1) in a direction Y located in the plane of FIG. 1 perpendicularly to the direction X of the optical axis of the spectrometer, an electrostatic sector 2 and a magnetic sector 3. An input slit $W_{1y}$ positioned in an input plane P1 has, as an image through the electrostatic sector 2, a slit $W_{2y}$ positioned in the plane P2 which is the image of the plane P1.

Figure 2:
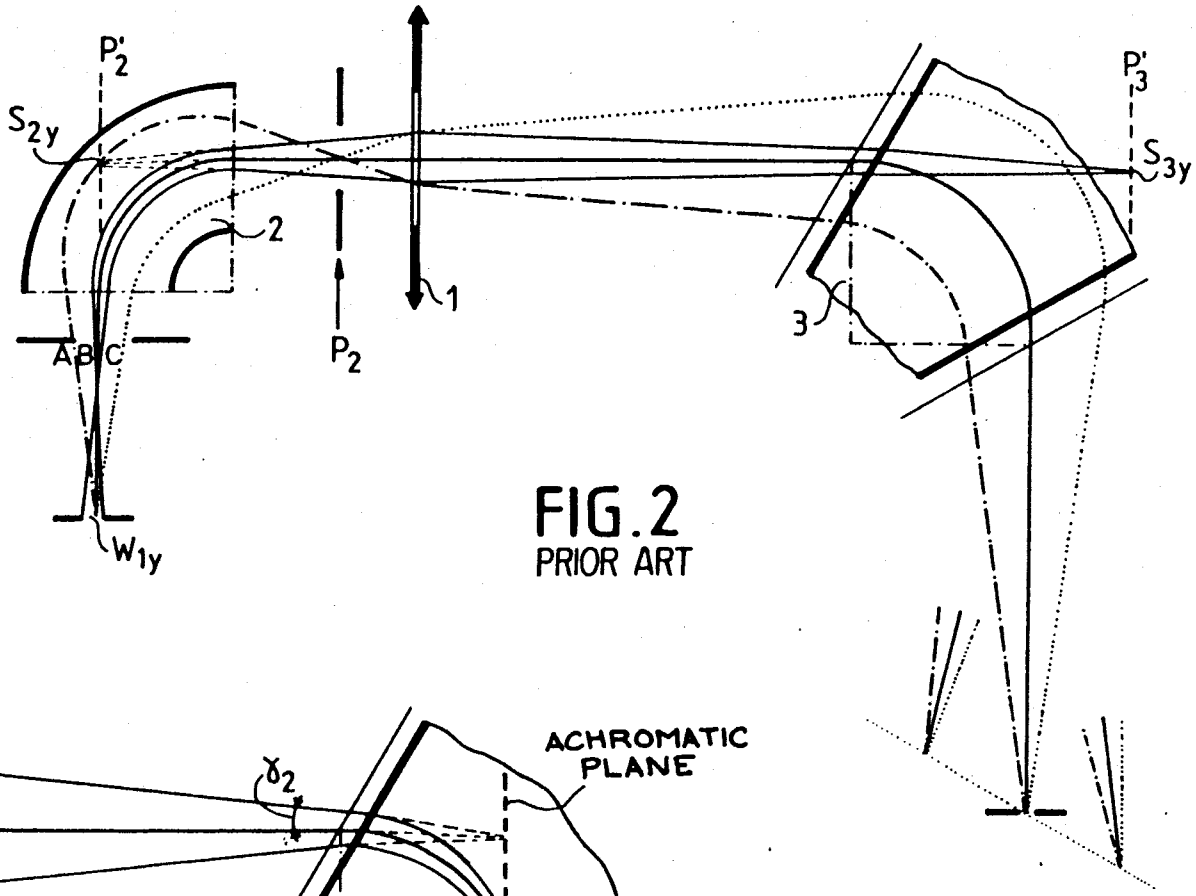
FIG. 2 PRIOR ART
FIG. 2 shows the positions of the images of the plane of the sample in an IMS3F type apparatus.

In FIG. 2, $S_{2y}$ is the virtual image of the sample given by the electrostatic sector in the plane P'2.

Figure 1:
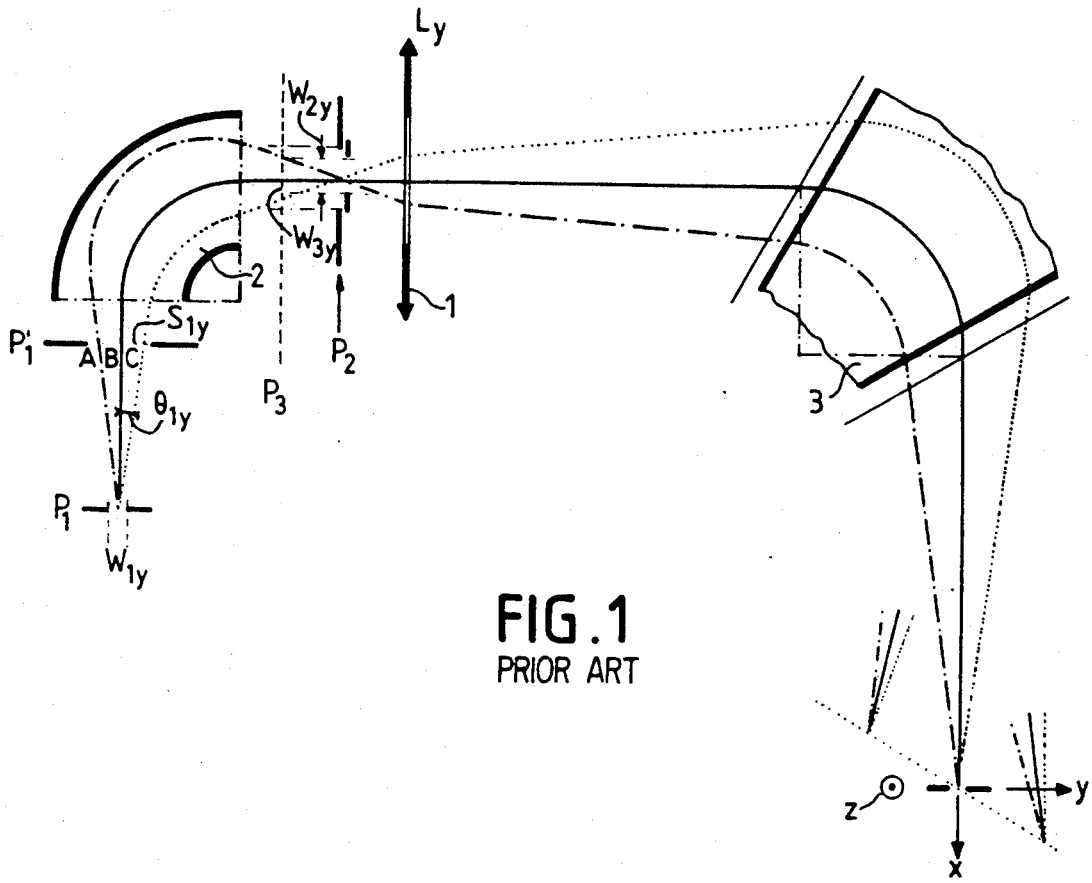
FIG. 1 PRIOR ART
FIG. 1 shows the construction of the images from the input slit in an IMS3F type apparatus.

In FIG. 1, the optical system $L_y$ converts the slit $W_{2y}$ into an image $W_{3y}$ positioned, in FIG. 1, in a plane P3 and, in FIG. 2, it converts the virtual image of the sample $S_{2y}$ into an image $S_{3y}$ in a plane P'3.

Figure 3:
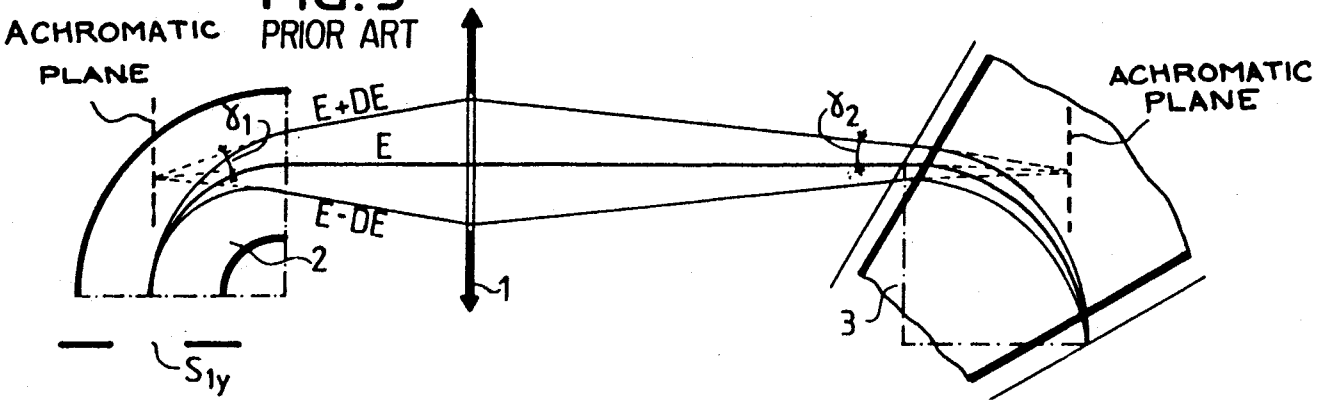
FIG. 3 PRIOR ART
FIG. 3 shows the positions of the achromatic planes of the electrostatic and magnetic sectors of an IMS3F apparatus.

The result of this is that the pairs of planes (P2, P3) and (P'2, P'3) appear to be conjugate with respect to the optical system 1. The arrangements of the electrostatic and magnetic sectors are shown in FIG. 3.

Letting $K_M$ and $K_E$ designate the coefficients of energy dispersion of the sectors 2 and 3, the achromatism on the axis X makes it necessary to verify the conjugation of the achromatic planes as well as a condition on the enlargement such that the relationship:

$$W_{3Y}/W_{2Y}=K_M/K_E \quad (4)$$

is verified.

Along the direction normal to the plane of the FIGS. 1 and 2, one and the same optical coupling system, represented by a lens $L_Z$ (not shown), is used to conjugate the same plane pairs (P2, P3) and (P'2, P'3). In a manner similar to that of the working of the lens $L_y$, referring to FIG. 4B the lens $L_Z$ converts the slit $W_{2Z}$ into a slit $W_{3Z}$ located in the plane P3 and converts the image $S_{2Z}$ (not shown) into an image $S_{3Z}$ (not shown) on the plane P'3 on condition, this time, that the following relationship:

$$W_{3Z}/W_{2Z}=\lambda(K_M/K_E) \quad (5)$$

is verified where $\lambda$ is a coefficient close to 5.

Under these conditions, the coefficients of multiplication applied to the enlargements make it possible to obtain a reduction of $1/\lambda$ on the apertures.

However, it is not absolutely indispensable to make an isotropic image of the input slit in the plane of the output slit for, to carry out a mass discrimination, it is enough to fulfil only this condition in the direction Y. However, experience shows that the settings are simplified in a quite promising way when, at the output plane, there is an isotropic image of the input slit. Given the two pairs of planes (P2, P'2) and (P3, P'3) positioned on the optical axis X at the coordinate points ($X_2$, $X'_2$) and ($X_3$, $X'_3$), the lens enables the simultaneous conjugation of the two pairs of planes if its abscissa X verifies the equation:

$$X^2\left(\frac{1}{x_2-x'_2}-\frac{1}{x_3-x'_3}\right)- X\left(\frac{x_2+x'_2}{x_2-x'_2}-\frac{x_3+x'_3}{x_3-x'_3}\right)+\frac{x_2x'_2}{x_2-x'_2}-\frac{x_3x'_3}{x_3-x'_3}=0 \quad (6)$$

and its focal length f is given by $$\frac{1}{f}=\frac{1}{X-x_2}-\frac{1}{X-x'_2} \quad (7)$$

The relationships (4), (6) and (7) suggest that the two solutions of the equation may represent the respective positions of a lens $L_y$ and a lens $L_z$, each conjugating the two pairs of planes (P2, P'2) and (P3, P'3). $L_y$ designates a lens with slit or a rectangular lens that is active in the direction Y and practically neutral in the direction Z. $L_z$ designates a lens with slit or a rectangular lens that is active in the direction Z and practically neutral in the direction Y.

Figures 4A, 4B:
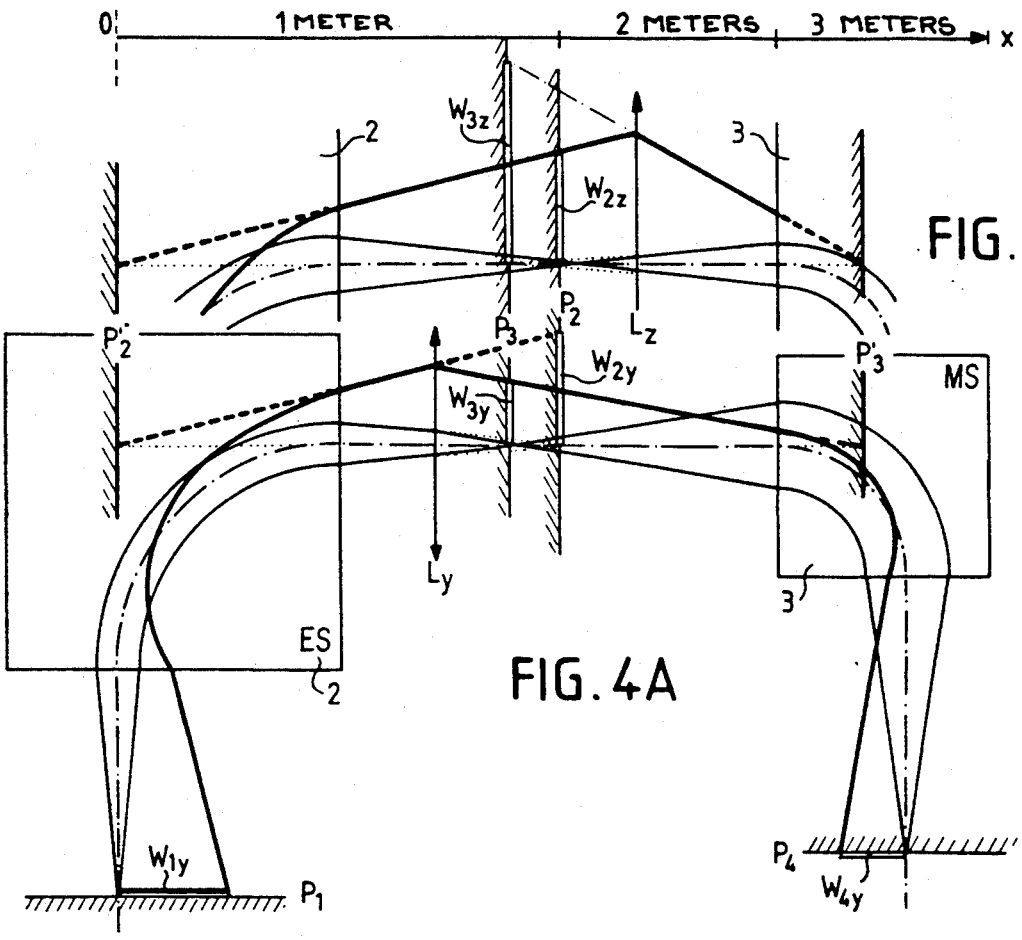
FIGS. 4A and 4B show an embodiment of an optical coupling system according to the invention, using two lenses $L_Y$ and $L_z$ positioned between the two sectors MS and ES.

FIGS. 4A and 4B, where the elements similar to those of FIGS. 1, 2 and 3, are represented with the same references, illustrate this arrangement. More particularly, this arrangement corresponds to an embodiment where the electrostatic sector 2 is a spherical sector with a radius of one meter. Consequently, $K_E=2$ meters and P2 is at one meter from the output of the electrostatic sector 2 (ES). In FIG. 4A, as in FIG. 4B, the starting point of the abscissa, is at the achromatic plane of the electrostatic sector 2. The achromatic plane P'2 is one meter upline from the output of the electrostatic sector. The magnetic sector 3 is flanked by two spaces such that the input plane is conjugated with the output plane, its chromatic dispersal K=1.2 m at the output plane P4 and its input achromatic plane is at a distance of 1.6 m from the input plane P3.

The relationship (5) makes it necessary for $L_y$ to carry out an enlargement $W_{3y}/W_{2y}=0.6$. This relationship, related to the condition of conjugation between the achromatic planes of the sectors, determines the position of the lens $X_y=1.449$ m, its focal length $f_y=0.827$ m and, consequently, the abscissae of the image plane P3 ($X_3=1.780$ m) and of the achromatic input plane (3.380 m) of the magnetic sector MS.

In FIG. 4A, P'2 is taken at the starting point, 0 as in the case of IMS3F. P'2 is consequently the achromatic output plane of the electrostatic sector 2 and, consequently, P'3, the conjugate plane of P'2, is the achromatic input plane of the magnetic sector MS To find the position and the focal length of the lens $L_z$ (FIG. 4B), it is necessary to resolve the equation (6) with $x_2=2$m, $x'_2=0$m, $x_3=1.780$ m, $x'_3=3.380$ m. The two solutions of the equation are, firstly, the abscissa value $X_y$ which is already known and, secondly, the abscissa value of the lens Lz, namely $X_z=2.306$ m. The focal length $f_z$ is, under these conditions, equal to 0.732 m.

The enlargement in the direction Z, $W_{3z}/W_{2z}$, is then 1.716, namely 2.86 greater than the enlargement in the direction Y.

This arrangement makes it possible to place an energy discriminating slit at the plane P3 where a real image of the input slit is found. However, it is limited in its practical applications in that, to obtain an appreciable ratio of enlargement in the directions Y and Z, it is necessary for the enlargement along Y to be smaller than 1 which, according to the relationship (4), corresponds necessarily to a ratio $K_E/K_M$ is greater than 1 and hence, since the chromatic dispersions depend very greatly on the radii, to a radius of ES of the electrostatic sector 2 that is greater than that of the magnetic sector 3: it is all the greater as it is sought to create a high ratio of enlargement between the directions Z and Y. Thus, in the case of FIGS. 4A and 4B, the ratio of 2.86 can be obtained only if the radius of the electrostatic sector ES is one meter, the radius of the magnetic sector MS being dictated at 0.585 m A dimension such as this may be quite excessive, because of the bulk that it may give rise to, and because of the technological difficulty of making the electrostatic sector.

Figures 5A, 5B:
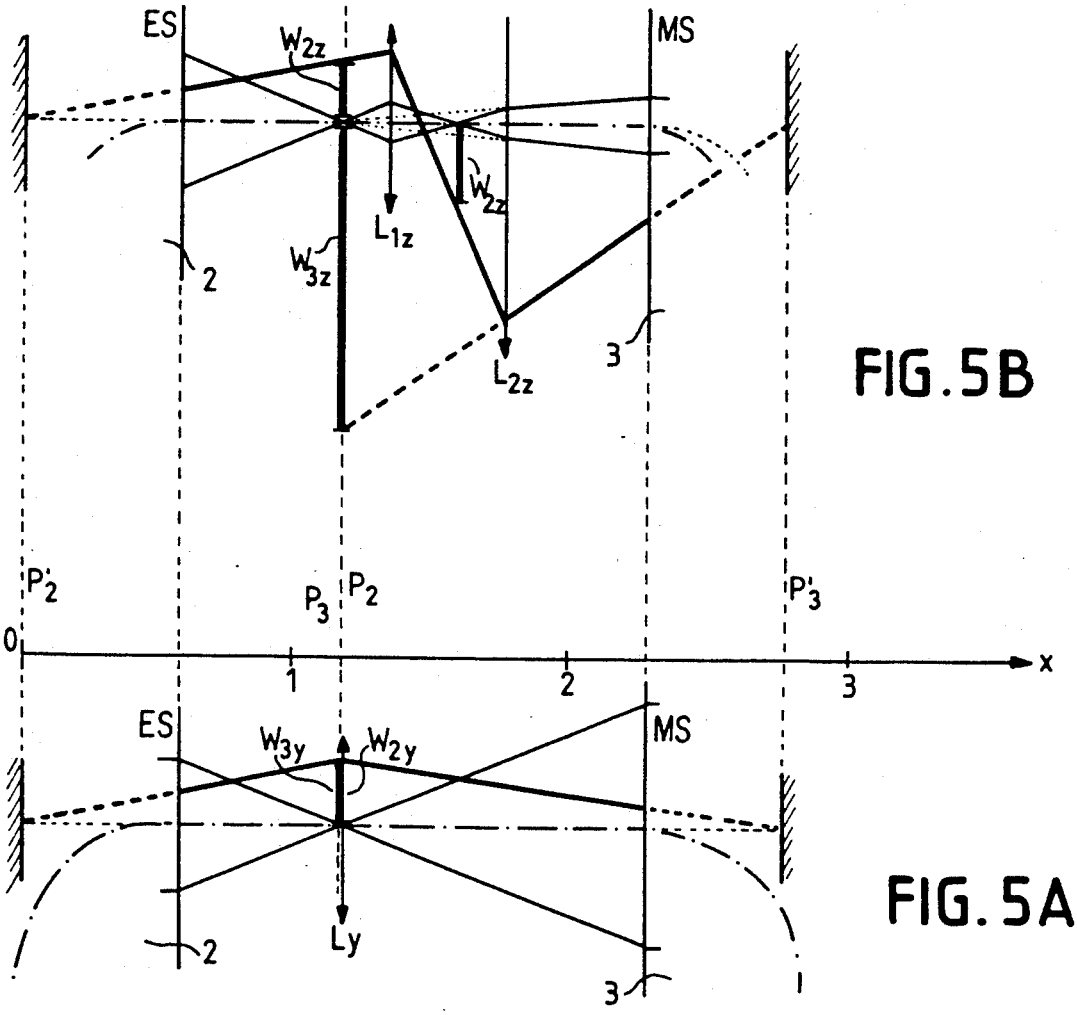
FIGS. 5A and 5B show an embodiment of an optical coupling system according to the invention, using a lens Ly and two lenses $L_{1z}$ and $L_{2z}$.

According to a second alternative embodiment of the invention, the arrangement shown in FIGS. 5A and 5B can be used to get rid of this constraint: it has a lens Ly (FIG. 5A) located downline from the plane P2 and two lenses active in the direction Z, $L_{1z}$ and $L_{2z}$ (FIG. 5B). The lens $L_{1z}$ images the slit $W_{2z}$ with an enlargement close to 1 and the lens $L_{2z}$ acts as a magnifying glass to give an image with an enlargement of the order of 5 in meeting the relationship (6). With an electrostatic sector having the shape of a spherical sector with a radius of 0.585 meters, $K_E=1.17$ meters and the plane P2 is at 0.585 meters from the output of the electrostatic sector 2. The magnetic sector 3 is identical to that of the previous example. As earlier, the starting point of the abscissae is in the achromatic plane of the electrostatic sector 2. relationship (4) makes it necessary for the lens $L_y$ achieve an enlargement $W_{3y}/W_{2y}=1.03$. This relationship, associated with the condition of conjugation between the achromatic planes of the sectors, determines the position of the lens $X_y$ at 1.190 m and its focal length $f_y$ is equal to 0.679 m. Consequently, the abscissae values of the image plane P3 and of the achromatic plane of the magnetic sector 3 are respectively positioned at 1.169 m and 2.769 m.

Starting from the instant when $L_{1z}$ is fixed in position and in convergence, the position of the lens $L_{2z}$ and its focal length are determined by carrying, into the equations (6) and (7), the values $X_2=1.17$ m, $X'_2=0$m, $X_3=1.169$ m and $X'_3=2.769$ m. By way of an example, a possible arrangement to obtain an enlargement $W_{3z}/W_{2z}$ that is 5.3 times greater than the enlargement $W_{3y}/W_{2y}=1.03$ may be obtained with the following characteristics:

Positions of $L_{1z}=1.336$ m
Focal length of $L_{1z}=0.1$ m
Positions of $L_{2z}=1.760$ m
Focal length of $L_{1z}=0.241$ m With this configuration, the intermediate enlargement $W_{21z}/W_{2z}$ is $-1.538$. This arrangement enables an energy discriminating slit to be placed in the plane 2 where a real image of the input slit is found.

Finally, according to a third embodiment of the invention, it may be advantageous to replace the lens $L_y$ by two lenses $L_{1y}$ abd $L_{2y}$ placed on each side of the plane P2. As already shown in FIGS. 5A and 5B, the position and convergence of the lens $L_y$ are very strictly dictated by the optical characteristics of the electrostatic sector 2 and magnetic sector 3. Now, these sectors are not necessarily known with precision when the apparatus is being mounted and, while it is obviously easy to adjust the focal length of the lens $L_y$, this is not the case with respect to its position. Under these conditions, the replacing of the lens Ly by two lenses $L_{1y}$ and $L_{2y}$ creates a zoom effect giving the operator scope for adjustment that he did not have with only one lens. This arrangement makes it possible to position an energy discrimination slit in the intermediate plane P21 where a real image of the input slit is found. This has an advantage, should the enlargement $W_{3y}/W_{2y}$ be close to 1.

Figures 6A, 6B:
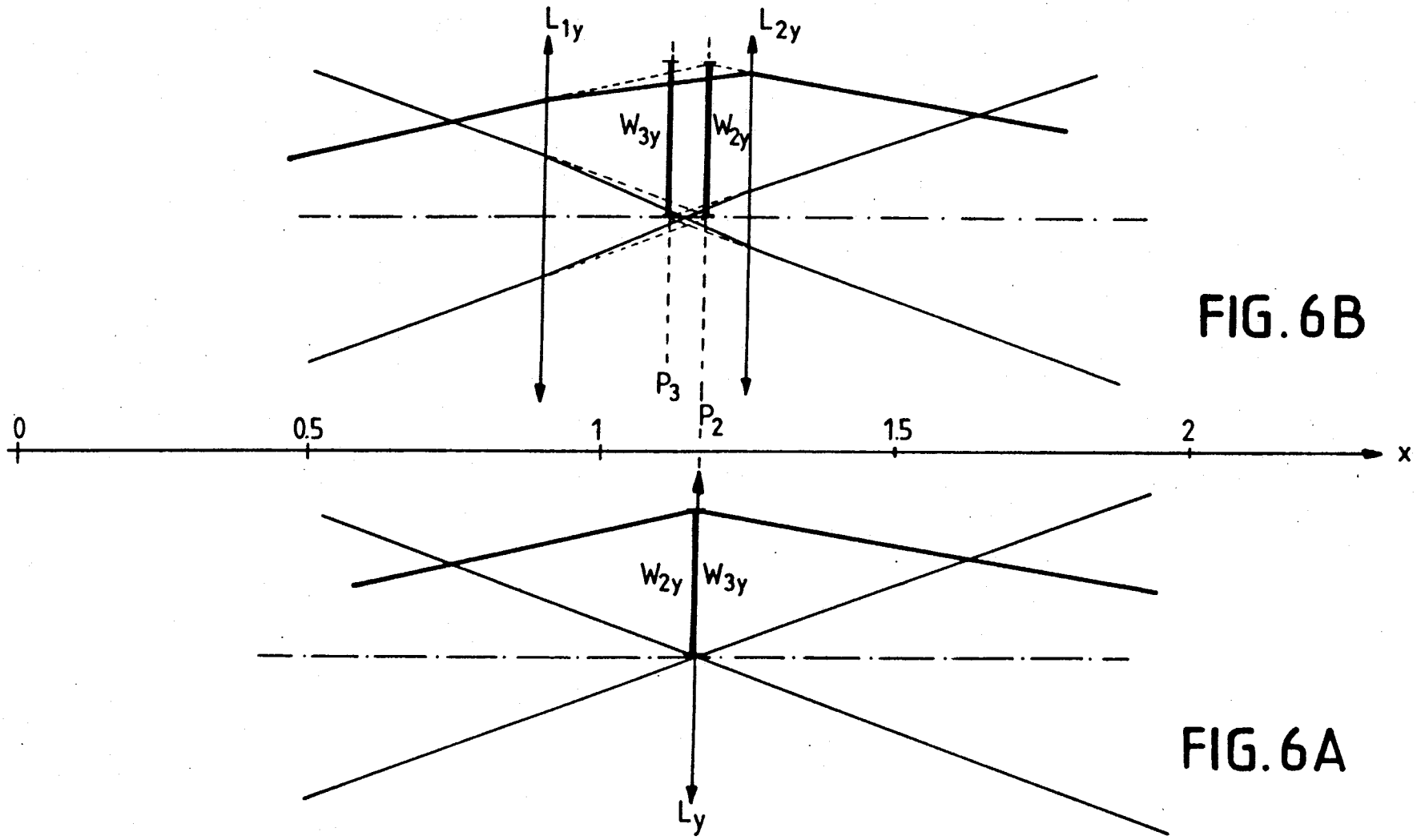
FIG. 6A shows an embodiment of an optical coupling system using only one lens Ly.
FIG. 6B shows an embodiment of an optical coupling system using two lens $L_{1y}$ and $L_{2y}$.

FIGS. 6A and 6B show how the lens $L_y$ of the example of FIGS. 5A and 5B may be replaced by two lenses $L_{1y}$ and $L_{2y}$ positioned as follows:

Position of $L_{1y}=0.900$ m
Focal length of $L_{1y}=2.250$ m
Position of $L_{2y}=1.250$ m
with a focal length of $L_{1y}=0.820$ m Since the magnetic sector 3 is a device that generally does not have the same properties of focusing in the direction Y and in the direction Z, it is necessary to compensate for its astigmatism. As shown above, the shape given to the input faces of the magnetic sector 3 gives it an equivalent optical diagram constituted by a doublet of lenses. The lenses then have an equal focal length for the two directions Oy and Oz, namely $f_m$, but the space between them is not identical in both directions.

To enable the elimination of a stigmator placed just upline from the output slit so as to enable the projection, on an intensifier, of a stigmatic image of the sample, it is enough, in the equation (6) to modify the parameter $X'_3$ so as to take account of the disparity of the spaces in the directions Y and Z in the equivalent diagram of the magnet so that, downline from the magnet, both the image of the input slit and that of the sample are stigmatic.

The advantage of eliminating the stigmator located before the input slit is that this completely frees the space at this level and therefore makes it possible, for example, to collect several different masses in parallel.

What is claimed is:

1. A high transmission stigmatic mass spectrometer with double focusing, of the type comprising:

an optical coupling system between an electrostatic sector and a magnetic sector, the electrostatic and magnetic sectors are between an input slit ($W_{1y}$, $W_{1z}$) and an output slit ($W_{4y}$, $W_{4z}$), the input and output slits are crossed by ionized particles emitted by a sample;

wherein said optical coupling system comprises at least two lenses ($L_y$) and ($L_z$) with slits oriented respectively along a first direction (Y) parallel to a plane containing an incurvated path along which the ionized particles travel, said incurvated path is incurvated by the electrostatic and magnetic sectors, and along a second direction (Z) perpendicular to the plane containing the incurvated path, and wherein the first lens ($L_y$) and the second lens ($L_z$) are located on opposite sides of a conjugate plane (P2) of the input slit by the electrostatic sector, and wherein the position of the first lens ($L_y$) and its focal length are determined, firstly, to conjugate the image ($W_{2y}$) of the input slit ($W_{1y}$) obtained in the conjugate plane (P2) by an image in a plane (P3) with an enlargement ($W_{3y}/W_{2y}$) equal to a ratio respectively of the coefficients of dispersion in mass ($K_M$) and ($I_E$), of the magnetic sector and of the electrostatic sector and, secondly, to conjugate the virtual image of the sample ($S_{2y}$) given by the electrostatic sector in a plane (P'2) into an image ($S_{3y}$) in an achromatic plane ('3) of the magnetic sector.

2. A high transmission stigmatic double focusing mass spectrometer for determining composition of a sample, comprising:

an input slit means for passing an ion beam therethrough;

an electrostatic sector means for electrostaticly deflecting said ion beam passed through said input slit means;

a magnetic sector means opposed to said electrostatic sector means for magnetically deflecting said ion beam, wherein one of said electrostatic sector means and said magnetic sector means receives said ion beam form said input slit means and directs said ion beam toward the other one of said electrostatic sector means and said magnetic sector means;

an output slit for passing selected ions of said ion beam therethrough, wherein said other one of said electrostatic sector means and said magnetic sector means directs said ion beam toward said output slit;

an optical coupling system between the magnetic sector means and the electrostatic sector means which comprises a first lens with a first slit oriented along a first plane in which a path of said ion beam is incurvated and a second lens with a second slit oriented along a second plane that is perpendicular to said first plane;

wherein positions of the two lenses along the optical axis of the spectrometer provide compensation for chromatic dispersions along the optical axis downline from the spectrometer, a stigmaticimage of the input slit in an output plane of the spectrometer, and a stigmatic image downline from the spectrometer;

wherein the first lens and the second lens are located on opposite sides of a conjugate plane of the input slit, a position of the first lens and a focal length of the first lens are determined so that the first lens conjugates an input slit image in a conjugate plane of the input slit to produce a magnified image having a magnification equal to a ratio of a coefficient of dispersion in mass of the magnetic sector to a coefficient of dispersion in mass of the electrostatic sector, and a position of the first lens and a focal length of the first lens are determined so that the first lens also conjugates a virtual image of the sample provided by the electrostatic sector at a virtual image plane into an image at an achromatic plane of the magnetic sector.

3. A spectrometer according to claim 2, wherein:

said one of said electrostatic sector means and said magnetic sector means is said electrostatic sector means.

4. A spectrometer according to claim 2, wherein the position and the focal length of the first lens ($L_z$) are determined, firstly, to conjugate the planes (P2, P3) or the planes (P'2, P'3) to convert the image ($W_{2z}$) of the slit ($W_{1z}$) into an image ($W_{3z}$) in the plane P3 with an enlargement ($W_{3z}/W_{2z}$) that is proportional to the ratio of the coefficients of mass dispersion ($K_M$) and ($K_E$) of the magnetic sector and of the electrostatic sector and, secondly, to conjugate the virtual image of the sample ($S_{2z}$) given by the electrostatic sector in the plane (P'2) into an image ($S_{3z}$) in the achromatic plane (P'3) of the magnetic sector.

5. A spectrometer according to claim 4, wherein the position of the first lens ($L_z$) is determined by the solutions of an equation having the form:

$$X^2\left(\frac{1}{x_2 - x'_2} - \frac{1}{x_3 - x'_3}\right) - X\left(\frac{x_2 + x'_2}{x_2 - x'_2} - \frac{x_3 + x'_3}{x_3 - x'_3}\right) + \frac{x_2x'_2}{x_2 - x'_2} - \frac{x_3x'_3}{x_3 - x'_3} = 0 \quad (6)$$

in which ($x_2$, $x'_2$) and ($x_3$, $x'_3$) designate the positions of the plane pairs ($P_2$, $P'_2$) and ($P_3$, $P'_3$) and the focal length of the first lens determined by the relationship:

$$\frac{1}{f} = \frac{1}{X - x_2} - \frac{1}{X - x'_2} \quad (7)$$

wherein X is a distance along an optical axis of the spectrometer from an electrostatic sector virtual image in the virtual image plane $P'_2$, of a source of said ion beam, $P_2$ is an image plane of the input slit means, $P_3$ is an image plane of a slit in plane $P_2$ formed by said second lens and $P'_3$ an image plane of said second lens for virtual images in plane $P'_2$.

6. A spectrometer according to claim 2, comprising an energy discriminating slit positioned between the first and second lenses ($L_y$) and ($L_z$) in a plane conjugated with the input slit for the lens ($L_y$).

7. A spectrometer according to claim 2, comprising an optical system active in the direction z formed by the assembly of two lenses, a first lens ($L_{1z}$) and a third lens ($L_{2z}$), wherein the first lens ($L_{1z}$) inverts the image of the input sit produced by the electrostatic sector with a ratio close to $-1$, and wherein the third lens ($L_{2z}$) acts as a magnifying glass on the inverted image of the slit given by the first lens ($L_{1z}$).

8. A spectrometer according to claim 7, wherein the position of the third lens ($L_{2z}$) is determined by the solutions of an equation having the form:

$$X^2\left(\frac{1}{x_2 - x'_2} - \frac{1}{x_3 - x'_3}\right) - X\left(\frac{x_2 + x'_2}{x_2 - x'_2} - \frac{x_3 + x'_3}{x_3 - x'_3}\right) + \frac{x_2x'_2}{x_2 - x'_2} - \frac{x_3x'_3}{x_3 - x'_3} = 0 \quad (6)$$

wherein ($x_2$, $x'_2$) and ($x_3$, $x'_3$) designate the positions of the plane pairs ($P_2$, $P'_2$) and ($P_3$, $P'_3$) and wherein the focal length f of the third lense is determined for a relationship with the form $$\frac{1}{f} = \frac{1}{X - x_2} - \frac{1}{X - x'_2} \quad (7)$$

wherein X is a distance along an optical axis of the spectrometer from an electrostatic sector virtual image in the virtual image plane $P'_2$, of a source of said ion beam, $P_2$ is an image plane of the input slit means, $P_3$ is an image plane of a slit in plane $P_2$ formed by said second lens and $P'_3$ an image plane of said second lens for virtual images in plane $P'_2$.

9. A spectrometer according to claim 5, wherein the first lens ($L_y$) is a single lens.

10. A spectrometer according to claim 9, wherein an energy discriminating slot is positioned between the output of the electrostatic sector and the first lens ($L_y$) in the conjugate plane (P2) of the input slit means.

11. A spectrometer according to claim 7, wherein the first and third lenses ($L_{1y}$) and ($L_{2y}$) are located on each side of a conjugated plane (P2) of the input slit means.

12. A spectrometer according to claim 11, wherein an energy discriminating slit is positioned between the first and third lenses ($L_{1y}$) and ($L_{2y}$) at the conjugate plane of a slit ($W_{1y}$) by the first lens ($L_{1y}$).

13. A spectrometer according to claim 12, wherein positions of the first and third lenses compensate for the stigmatism defects of the magnetic sector.

* * * * *